United States Patent [19]

Middleton

[11] Patent Number: 4,824,322

[45] Date of Patent: Apr. 25, 1989

[54] PERIPHERAL TOROIDAL BLOWERS

[75] Inventor: Andrew H. Middleton, Southampton, United Kingdom

[73] Assignee: British Gas Corporation, London, England

[21] Appl. No.: 638,493

[22] Filed: Aug. 7, 1984

Related U.S. Application Data

[63] Continuation of Ser. No. 378,235, May 14, 1982, abandoned.

[30] Foreign Application Priority Data

Aug. 3, 1981 [GB] United Kingdom ..... 8123667

[51] Int. Cl.[4] ..... F01D 1/12

[52] U.S. Cl. ..... 415/53 T; 415/119; 181/293

[58] Field of Search ..... 415/53 T, 53 R, 119, 415/213 T, 214; 181/DIG. 1, 224, 293, 286

[56] References Cited

U.S. PATENT DOCUMENTS

| | | | |
|---|---|---|---|
| 3,346,174 | 10/1967 | Lievens | 415/119 |
| 3,542,152 | 11/1970 | Adamson | 415/214 UX |
| 3,555,095 | 11/1967 | Hollenburg | 415/119 |
| 3,947,148 | 3/1976 | Holt | 415/119 |
| 3,976,393 | 8/1976 | Larson | 415/119 |

FOREIGN PATENT DOCUMENTS

| | | | |
|---|---|---|---|
| 958966 | 5/1964 | United Kingdom | 181/224 |
| 1496781 | 1/1978 | United Kingdom | 415/53 T |

OTHER PUBLICATIONS

"Noise and Vibration Control", Leo L. Beranek, pp. 245–252, McGraw-Hill Book Co., 1971.

*Primary Examiner*—Robert E. Garrett
*Assistant Examiner*—Joseph M. Pitko
*Attorney, Agent, or Firm*—Staas & Halsey

[57] ABSTRACT

A peripheral toroidal blower has a stripper consisting of a central block part and two curved vanes projecting one from each end of the block part and extending in opposite directions around the toroidal chambers to at least partially cover the inlet and outlet ports. The active surfaces of the stripper are of porous material whereby to provide a substantial reduction in blade passing frequency noises. The active surfaces may be of inherently porous material such as polyurethane foam or of a nominally closed cell plastics foam of which the active surfaces are made porous by machining or cutting.

10 Claims, 3 Drawing Sheets

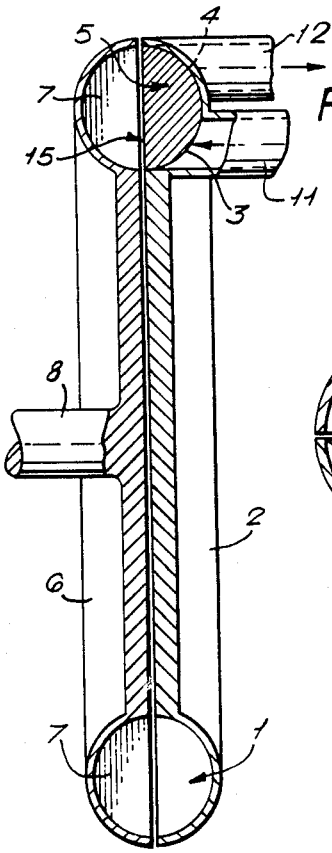
FIG. 2.
FIG. 4a.
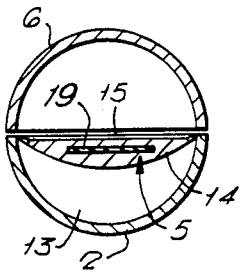
FIG. 4b.
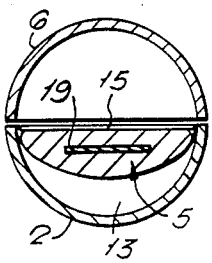
FIG. 4c.
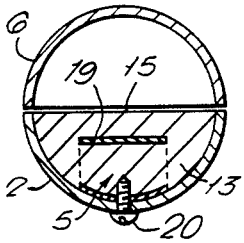
FIG. 3.
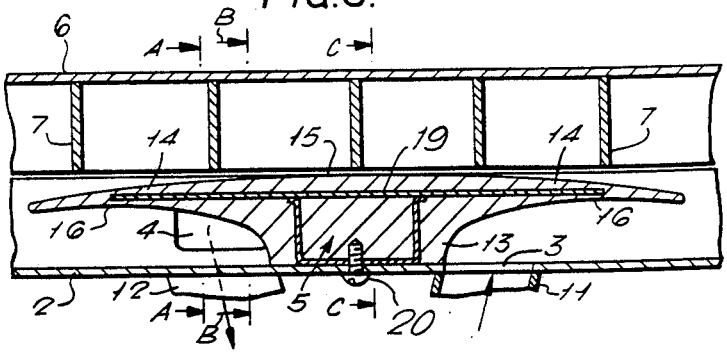

PERIPHERAL TOROIDAL BLOWERS

This is a continuation of application Ser. No. 378,234, filed on May 14, 1982, now abandoned.

BACKGROUND OF THE INVENTION

This invention relates to peripheral toroidal blowers of the kind (hereinafter referred to as the kind specified) comprising a toroidal chamber which is divided along a plane at right angles to its axis into a part bounded by a stator housing having adjacent inlet and outlet ports with a stripper between them and a part bounded by a rotor housing containing a series of impeller blades. The impeller blades and the stripper are arranged in such a way that when the rotor housing is rotated a flow of air is induced into the chamber through the inlet port along a helical path, the axis of which extends around the toroidal chamber, and out of the chamber through the outlet port.

PRIOR ART

In British Patent Specification No. 1 496 781 there is disclosed a peripheral toroidal blower of the kind specified in which the stripper consists of a solid block part whose central cross-section corresponds to the cross-section of the hemi-toroidal stator in which it is fixed, and two shaped vanes projecting one from each end of the block part and arranged to extend in opposite directions around the toroidal chamber so that they at least partially cover the inlet and outlet ports respectively but are spaced therefrom, the radial width of each vane gradually diminishing from its root connection with the block part of the stripper to its free tip end. The stripper is formed from non-porous material of sufficient mechanical strength, for example, diecast metal or moulded plastics material.

Noise is generated at blade passing frequency as a result of the interaction of the air contained between the moving blades and the stationary stripper. The shaped vanes of non-porous material projecting from the block part reduce this blade passing frequency noise; however, the object of the present invention is to provide a greater degree of noise reduction.

SUMMARY OF THE INVENTION

According to the present invention, in a peripheral toroidal blower of the kind specified the stripper consists of a solid block part whose central cross-section corresponds to the cross-section of the hemi-toroidal stator in which it is fixed, and two shaped vanes projecting one from each end of the block part and arranged to extend in opposite directions around the toroidal chamber so that they at least partially cover the inlet and outlet ports respectively but are spaced therefrom, the radial width of each vane gradually diminishing from its root connection with the block part of the stripper to its free tip end, and at least the active surfaces of the stripper being of porous material.

The stripper may be substantially rigid or may have a degree of flexibility and may be formed from inherently porous material, or from a material, such as a cellular material, which can be machined or cut to provide the active surfaces of porous construction. For example, when the stripper is to be of substantially rigid material it may be formed from rigid polyurethane foam or from unglazed ceramic material. When the stripper is to have a degree of flexibility it may be formed, for example, from nominally closed cell semi-rigid polyethylene foam and the active surfaces may be provided by machining or cutting a block of the foam to the desired shape. The stripper may also be formed from a material consisting of bonded fibres.

It has been found that strippers having active surfaces of the above-mentioned porous materials have the unexpected advantage that the noise generated by the blow is considerably reduced.

BRIEF DESCRIPTION OF THE DRAWINGS

The invention will now be described, by way of example, with reference to the accompanying diagrammatic drawings in which:

FIG. 2 is a sectional side elevation of the line II—II of FIG. 1;

FIG. 3 is an enlarged developed fragmentary sectional plane on the line III—III of FIG. 1 but including the rotor;

FIGS. 4*a*, 4*b* and 4*c* are sections on the lines A—A, B—B, and C—C respectively of FIG. 3;

DESCRIPTION OF THE PREFERRED EMBODIMENTS

Figure 1:
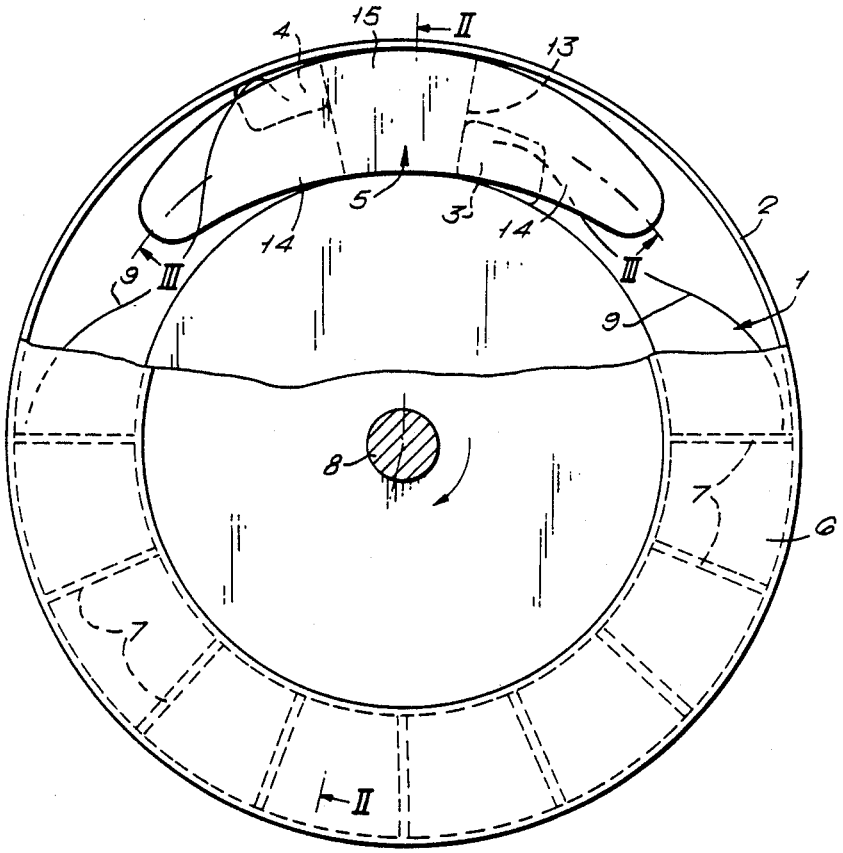
FIG. 1 is an end elevation, partly broken away, of a peripheral toroidal blower according to one embodiment of the invention.

Referring in the first instance to FIGS. 1 to 4, the peripheral toroidal blower, which is suitable for use in a gas-fired heating system, comprises a toroidal chamber 1 divided along a plane at right angles to its axis into a chamber part bounded by a stator housing 2 having adjacent inlet and outlet ports 3 and 4 respectively with a stripper 5 located between, and a chamber part bounded by a rotor housing 6 containing a plurality of fixed radially extending impeller blades 7. The impeller blades 7 and stripper 5 are arranged such that, upon rotation of the rotor housing 6 by a drive shaft 8, a flow of air is induced into the toroidal chamber through the inlet port 3 along a substantially helical path indicated at 9 in FIG. 1 (the axis of which extends around the toroidal chamber) and out of the chamber through the outlet port 4, the stripper 5 preventing recirculation.

The stator housing 2 is provided with an inlet passage in the form of a duct 11 communicating with the inlet port 3 and an outlet passage in the form of a duct 12 communicating with the outlet port 4. Both the inlet duct 11 and the outlet duct 12 preferably extend from the stator housing 2 in a direction away from the rotor housing 6 for ease of connection of further inlet and outlet ducts if these are necessary.

The stripper 5 is formed by a central block 13, arranged to be a snug fit in stator housing 2, and two curved vanes 14 extending one from each end of the block 13 so as almost to cover the inlet and outlet ports respectively. Each vane 14 is shaped such that its width in a radial direction and preferably also its thickness in an axial direction gradually diminishes from its root connection with the block 13 towards its radiused tip.

Preferably, the stripper is formed with a central flat region 15 in a plane at right angles to the axis of the blower and closely adjacent to the blade edges. Preferably also, each vane curves away slightly from the plane of the blade edges, and its surface 16 remote from the blades is curved to merge with its root connection with the central block 13 so as to provide a smooth passage for flow of air from and to the inlet and outlet ports 11 and 12 respectively.

In accordance with the invention at least the active surfaces of the stripper 5, that is those surfaces of the central block 13 and the two curved vanes 14 on which the air passing through the blower impinges, are of porous material. The stripper 5 may be formed from a block of material which is inherently porous such as, for example, unglazed ceramic material or polyurethane foam.

The stripper 5 may also be formed from cellular materials which are not normally porous but which can be provided with porous surfaces by a machining or cutting operation when shaping the stripper 5 from a suitable clock. With such cellular material each cell is sealed under normal circumstances, but when the material is cut or machined to shape the stripper 5, the cells adjacent to the shaped surface become ruptured thus forming a porous active surface. One such cellular material is a nominally closed cell semi-rigid polyethylene foam.

The stripper 5 is secured to the stator housing 2 by a support structure 19 which is embedded within the central block 13 and fastened to the stator housing 2 by one or more screws. Alternatively, the support structure 19 may be used to stiffen or to strengthen the stripper 5, which is then secured to the stator housing 2 by a suitable adhesive or by other means. Preferably the support structure is of metal and may be moulded within the central block 13.

The stripper 5 performs the function of separating the inlet and outlet ports, as in a conventional peripheral blower, by having a close clearance to the blades 7 over the flat central area 15, but by virtue of the tapering space through which the spirally circulating air has to flow as it enters the leaves the rotor, the impulsive pressure changes previously experienced with such conventional blowers are greatly reduced, with a consequent substantial reduction in blade passing frequency noises.

It has been found that using a stripper 5 of a non-porous material such as a metal, the noise was substantially 39 dB whereas using a rigid polyurethane stripper in accordance with the invention the noise was 34 dB and using a semi-rigid closed cell polyurethane stripper in accordance with the invention the noise was 29 dB. All the above noise levels refer to the noise emitted at blade passing frequency (in the present instance 1150 Hz) when the blower was operating at its designed air flow and pressure rise point. Thus the noise reduction obtained may be from 5 dB to 10 dB depending on the material constituting the active surfaces of the stripper. It is envisaged that other materials may provide even greater improvements in noise reduction.

Figure 5:
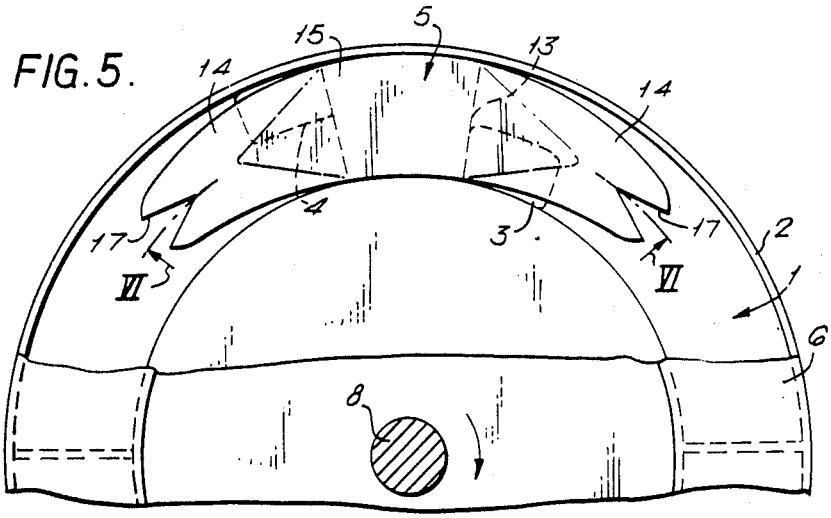
FIG. 5 is a fragmentary end elevation of the stator housing similar to the top portion of FIG. 1 but showing a modified form of stripper.
Figure 6:
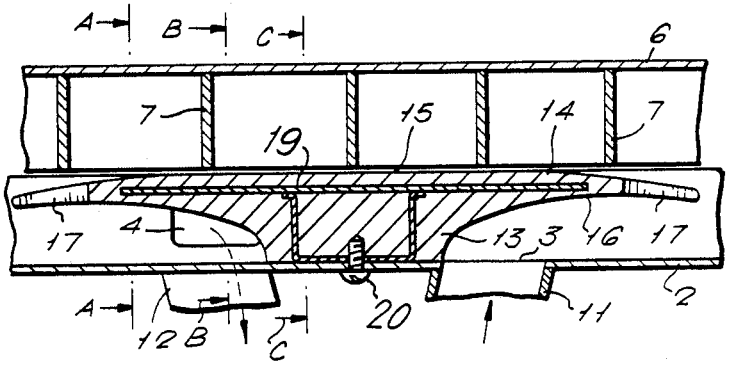
FIG. 6 is an enlarged developed fragmentary sectional plan on the line VI—VI of FIG. 5 but including the rotor.
Figure 7A:
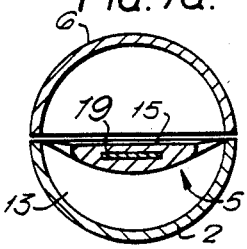
FIGS. 7*a*, 7*b* and 7*c* are sections on the lines A—A, B—B, and C—C respectively of FIG. 6.
Figure 7B:
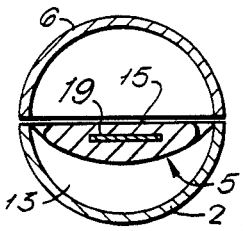
Figure 7C:
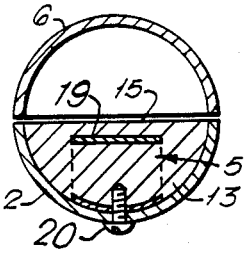

In the modified arrangement shown in FIGS. 5 to 7, the tip of each stripper vane is provided with a notch, for example, a V-shaped notch 17. Furthermore, the boundary of the central flat region 15 terminating on each vane is defined by a line substantially V-shaped, the apex of the vee pointing toward the respective notched vane tip.

I claim:

1. A peripheral toroidal blower comprising:

a stator housing having adjacent inlet and outlet ports, a rotor housing containing a series of impeller blades, said stator and rotor housings being mounted for relative rotation and defining a toroidal chamber therebetween, a stripper mounted in said toroidal chamber and between said inlet and outlet ports, said stripper and said impeller blades cooperating, when said stator and rotor housings rotate relatively, to induce the flow of air through said inlet port, around said toroidal chamber along a helical path and out through said outlet port, said stripper including a central block part and a pair of shaped vanes projecting respectively in opposite directions from said block part around said stator chamber, said vanes being respectively located in spaced, partial covering relationship relative to said inlet and outlet ports, the radial width of each said vane diminishing gradually from its point of connection with said block part to its free end, and stripper active surfaces defined by substantially all of the surfaces of said block part and said vanes upon which air passing through said peripheral toroidal blower impinges during operation, and formed of a cellular construction so that the generation of noise is reduced at blade passing frequency resulting from the interaction between said impeller blades and said stripper active surfaces during said relative rotation.

2. The peripheral toroidal blower of claim 1 including, said stripper active surfaces being constructed from a rigid polyurethane foam.

3. The peripheral toroidal blower of claim 1 including, said stripper active surfaces being constructed of unglazed ceramic material.

4. The peripheral toroidal blower of claim 1 including, said stripper including a support structure for securing it within said stator housing.

5. The peripheral toroidal blower of claim 2 including, said stripper including a support structure for increasing its rigidity.

6. The peripheral toroidal blower of claim 1 including, each said vane having a notched tip end.

7. The peripheral toroidal blower of claim 1 including, said cellular construction defining closed cells or pockets.

8. A peripheral toroidal blower comprising:

a stator housing having adjacent inlet and outlet ports, a rotor housing containing a series of impeller blades, said stator and rotor housing being mounted for relative rotation and defining a toroidal chamber therebetween.

a stripper mounted in said toroidal chamber and between said inlet and outlet ports, said stripper and said impeller blades cooperating, when said stator and rotor housing rotate relatively, to induce the flow of air through said inlet port, around said toroidal chamber along a helical path and out through said outlet port, said stripper including a central block part and a pair of shaped vanes projecting respectively in opposite directions from said block part around said stator chamber, said vanes being respectively located in spaced, partial covering relationship relative to said inlet and outlet ports, the radial width of each said vane diminishing gradually from its point of connection with said block part to its free end, and stripper active surfaces defined by substantially all of the surfaces of said block part and said vanes upon which air passing through said peripheral toroidal blower impinges during operation, and formed of a cellular construction so that the generation of noise is reduced at blade passing frequency resulting from the interaction between said impeller blades and said stripper active surfaces during said relative rotation, said stripper active surfaces being constructed of a cellular material which has been machined or cut to present said active surfaces.

9. The peripheral toroidal blower of claim 8 including, the cellular material from which said stripper active surfaces are constructed being a nominally closed cell plastics foam.

10. The peripheral toroidal blower of claim 9 including, said nominally closed cell plastics foam from which said stripper active surfaces are constructed being a nominally closed cell semi-rigid polyethylene foam.

* * * * *